United States Patent [19]

Urban et al.

[11] Patent Number: 4,647,367

[45] Date of Patent: Mar. 3, 1987

[54] ANTIFOULING AGENTS FOR PREVENTION OF UNWANTED COKE FORMATION IN REACTORS

[75] Inventors: Peter Urban, Northbrook; Frank Stolfa, Park Ridge, both of Ill.

[73] Assignee: UOP Inc., Des Plaines, Ill.

[21] Appl. No.: 812,532

[22] Filed: Dec. 23, 1985

[51] Int. Cl.[4] ..... C10G 9/12; C10G 9/16

[52] U.S. Cl. ..... 208/48 AA; 208/48 R; 208/107; 585/950

[58] Field of Search ..... 208/48 AA, 48 R, 107; 585/950

[56] References Cited

U.S. PATENT DOCUMENTS

| | | | |
|---|---|---|---|
| 3,502,571 | 3/1970 | Stolfa | 208/108 |
| 3,773,655 | 11/1973 | Stolfa | 208/107 |
| 3,974,066 | 8/1976 | Brown et al. | 208/289 |
| 4,113,604 | 9/1978 | Carlson | 208/289 |

*Primary Examiner*—Andrew H. Metz
*Assistant Examiner*—Helane Myers
*Attorney, Agent, or Firm*—Thomas K. McBride; John F. Spears, Jr.

[57] ABSTRACT

An antifouling compound comprising a phthalocyanine compound is disclosed for use in high temperature coke producing petroleum reactions wherein said coke is unwanted and acts as a fouling agent in the associated reaction apparatus.

14 Claims, No Drawings

ANTIFOULING AGENTS FOR PREVENTION OF UNWANTED COKE FORMATION IN REACTORS

BACKGROUND OF INVENTION

Certain petroleum processing reactions run at high temperature have a tendency to produce unwanted coke, defined as impure carbon deposits or agglomerations, and depositing said coke on the walls of the reactors and associated pipes and valve systems. This coke deposition prevents proper thermal transfer from the tubes in a reactor or clogs up the pipes and valve openings associated with these reactors thereby necessitating a shutdown of the system in order to remove the unwanted coke deposits. In order to decrease the need for a shutdown of the petroleum process, antifoulants can be added by: (1) coating the metal surfaces prior to reaction, (2) dissolving said antifoulants into the petroleum feedstock to be processed, or (3) by suspending said antifoulants in said feedstock.

BRIEF SUMMARY OF THE INVENTION

This invention relates to a method to prevent fouling of equipment used in high temperature coke producing petroleum reactions. More specifically, the invention is concerned with the addition of an anti-foulant to a hydrocarbon feedstock prior to reaction of said feedstock. Certain petrochemical reactions take place in such a way that unwanted coke or semipure carbon is produced and said coke acts as a foulant by coating the metal surfaces of the reaction chambers thereby necessitating the periodic shutdown of this process equipment for cleaning. We have found that the addition of an antifoulant to the feedstock prior to reaction of said feedstock will inhibit the coating of the metal surfaces of the reactor by said coke and, therefore, decrease the unproductive time used for cleaning the reactor and its associated piping and equipment.

It is therefore an object of this invention to prevent coke deposition fouling of processing equipment so as to thereby expand the useful time that said reactors can operate without having to be shut down and cleaned.

In one aspect, an embodiment of this invention resides in a method to prevent fouling of equipment used in high temperature coke producing petroleum reactions comprising subjecting a hydrocarbon feedstock to said reaction at reaction conditions in the presence of an antifoulant compound comprising a phthalocyanine compound.

A further embodiment of this invention consists of the use of a metallo-phthalocyanine compound as the antifoulant in the aforementioned coke producing petroleum reactions.

A still further enhanced embodiment is the preferred use of cobalt phthalocyanine as the antifouling agent in the petroleum coke-forming reactions.

Other objects and embodiments will be formed in the following further detailed description of the present invention.

DETAILED DESCRIPTION OF THE INVENTION

As hereinbefore set forth, this present invention is concerned with the prevention of deposition of unwanted coke on the metal surfaces and valves of a petroleum processing reactor. Said coke deposition or fouling is unwanted in that it prevents proper thermal transfer from the metal surface to the reacting petroleum feedstock, causes the eventual clogging of valving systems, reduces the flow rate of said feedstock, necessitates the use of higher pressures in the system, and necessitates use of higher temperatures with the concomittant economic increase. Once these sytems become fouled, the process must be shut down and the apparatus must be dismantled for cleaning, a non-productive waste of assets. Sometimes this mechanical cleaning can be done in situ but this method also involves the loss of production time. We had discovered a method in which the fouling by coke deposition onto metal surfaces is eliminated or greatly retarded through the addition of an antifoulant to the petroleum feedstock prior to processing, said antifoulant being a phthalocyanine compound.

Our invention can be practiced with such high temperature coke producing petroleum reactions or processes such as hydroprocessing, heavy oil hydrocracking, fluidized catalytic cracking, catalytic reforming, catalytic dehydrogenation, thermal cracking, vis-breaking, hydro vis-breaking, hydrocracking, and other like processes.

The petroleum feedstocks contemplated for use in this invention are feedstocks such as topped or reduced crudes, heavy distillates such as gas oils, naptha boiling range materials, kerosenes, and other similar feedstocks.

We also envision the use of this invention with the various catalytic procedures such as fixed bed catalysis, ebbulated bed catalysis, slurry catalysis, and other such catalytic procedures known to a person skilled in the art. Since it is well known that some catalysts can be poisoned by contamination with certain metals, the skilled practioner of this invention would not employ a metallo-phthalocyanine made from a metal detrimental to the particular catalytic system in use.

The phthalocyanine compounds include, but are not limited to, phthalocyanine, phthalocyanine polymers including metallo-phthalocyanine polymers, metallo-phthalocyanines, and phthalocyanine derivatives.

The metals from which the metallo-phthalocyanine can be prepared from include, but are not limited to, cobalt, copper, vanadium, platinum, palladium, molybdenum, aluminum, antimony, sodium, potassium, lithium, barium, beryllium, cadmium, calcium, chromium, dysprosium, erbium, europium, gadolinium, gallium, hafnium, holmium, indium, germanium, iron, lanthanum, lead, lutecium, magnesium, manganese, mercury, neodymium, nickel, osmium, rhodium, rhenium, samarium, silver, thorium, thulium, tin, titanium, uranium, ytterbium, and zinc.

The phthalocyanine polymers include, but are not limited to, those in which the phenylene rings of adjacent monomers are connected in the manner of a diphenyl bond, those in which the monomers are joined together by substituents attached to the phenylene rings, and those which share phenylene rings in common.

The phthalocyanine derivatives include, but are not limited to, phthalocyanine sulfates, phthalocyanine nitrates, phthalocyanine phosphates, phthalocyanine sulfonates, phthalocyanine carboxylates, phthalocyanine Werner type complexes with alkyl amines, halogenated phthalocyanine,polyhalogenated phthalocyanine, and phthalocyanine esters.

It is contemplated that this invention could be practiced in a single pass procedure, a recycling procedure, or any method known to one skilled in the art. The temperature range for use of this invention ranges from about 400° C. to about 800° C., and a pressure range of from about 1 to about 400 atmospheres, a residence time in the range of from about 0.1 to about 1 hour the concentration of the phthalocyanine compound ranges from about 70 ppm to about 10,000 ppm based on the hydrocarbon feedstock.

In one embodiment, an alcoholic mixture of cobalt phthalacyanine was dispersed into a topped crude oil by: (1) sonication of said cobalt phthalocyanine in an aqueous medium with a Sonifier 350 sonicator manufactured by Branson Lorie Power Company operating at a frequency range of 90–120×1000 Cycles per second. (2) addition of an alcohol with subsequent heating, and (3) contacting said topped crude with said alcoholic mixture of said cobalt phthalocyanine. This dispersed cobalt phthalocyanine was introduced to the topped crude oil feedstock and processed in a hydrovisbreaking operation with little or no coke fouling of the attendant apparatus. The hydrovisbreaking took place with a feedstock residence time of from about 0.1 to about 1 hour.

For purposes of this application and the appended claims, the words "coke deposits, coking and fouling" are used as equivalent terms.

The following examples are given for purposes of illustration. However, it is to be understood that these examples are only illustrative in nature and that this invention is not necessarily limited thereto.

EXAMPLE I

Vacuum bottoms underwent hydrovisbreaking for sixty two days under the following conditions with considerable fouling: 2500 pounds per square inch gauge (PSIG), inlet temperature of 315° C., outlet temperature of 460° C., hydrogen circulation of 10,000 standard cubic feet per barrell (SCF/B), 2.0 combined feed ratio , and 191 seconds residence time at 420° C.

EXAMPLE II

When 700 ppm of cobalt phthalocyanine, whose concentration was based on the hydrocarbon, was introduced into the vacuum bottoms of Example I and the identical reaction conditions were utilized, no fouling was observed for the duration of the hydrovisbreaking run.

EXAMPLE III

A sample of a topped crude oil was split into two equal portions. One portion was run as a control and the other had 10,000 ppm of cobalt phthalocyanine added with the concentration based on the hydrocarbon. Each sample was reacted in a glass lined, rotating bomb under hyudrovisbreaking conditions of a cold hydrogen pressure of 1500 PSIG, a maximum temperature of 400° C., and ended when the hydrogen pressure was reduced with a maximum running time of thirty minutes. The glass linings were then removed from the bombs and 14.0 weight percent of coke material was recovered from the control while no coke deposits occurred in the phthalocyanine sample run.

EXAMPLE IV

Further experiments were run under the same conditions as Example III and in the same manner of preparation of the topped crude but in an unlined rocking bomb. At the conclusion of these experiments, the samples with cobalt phthalocyanine showed no coking or fouling of the inner surface of the bomb while the control samples showed copious coking or fouling.

As can be seen in each of the sample and pilot plant runs, the introduction of cobalt phthalocyanine in concentrations ranging from 700 ppm to 10,000 ppm resulted in antifouling protection afforded to the reaction vessel.

We claim as our invention:

1. A method to prevent fouling of equipment used in high temperature coke producing petroleum reactions comprising the addition of an alcoholic aqueous mixture of an antifoulant comprising a phthalocyanine compound to a hydrocarbon feedstock at reaction conditions, said addition comprising the steps of:

(a) sonicating a mixture of a phthalocyanine compound with water to form an aqueous dispersion of said phthalocyanine;

(b) adding an alcohol to said aqueous dispersion to form an alcoholic aqueous dispersion of said phthalocyanine compound; and, (c) adding said alcoholic aqueous dispersion of said phthalocyanine compound to said hydrocarbon feedstock in an amount sufficient to reduce fouling of equipment employed during said high temperature coke producing petroleum reaction.

2. The method as set forth in claim 1 wherein said phthalocyanine compound is a metallo-phthalocyanine.

3. The method as set forth in claim 2 wherein the metal is cobalt.

4. The method as set forth in claim 2 wherein the metal is copper.

5. The method as set forth in claim 2 wherein the metal is vanadium.

6. The method as set forth in claim 2 wherein the metal is platinum.

7. The method as set forth in claim 2 wherein the metal is palladium.

8. The method as set forth in claim 2 wherein the metal is molybdenum.

9. The method as set forth in claim 1 wherein said reaction conditions include a pressure in the range of from about 1 to about 400 atmospheres, a residence time in the range of from about 0.1 to about 1 hour, and wherein said reaction temperature ranges from about 400° C. to about 800° C.

10. The method as set forth in claim 1 wherein said coke producing reaction is hydrovisbreaking.

11. The method as set forth in claim 1 wherein said feedstock comprises vacuum bottoms.

12. The method as set forth in claim 1 wherein said metallo-phthalocyanine is present in a range from about 70 ppm to about 10,000 ppm of the hydrocarbon feedstock.

13. The method as set forth in claim 1 wherein the metallo-phthalocyanine is polymeric in nature.

14. The method as set forth in claim 1 wherein said phthalocyanine compound is selected from the group consisting of phthalocyanine nitrates, phthalocyanine sulfates, phthalocyanine sulfonates, phthalocyanine carboxylates, phthalocyanine alkylamine Werner type complexes, phthalocyanine esters, and halogenated phthalocyanine, and polyhalogenated phthalocyanines.

* * * * *